US005398702A

United States Patent [19]

Belvederi

[11] Patent Number: 5,398,702

[45] Date of Patent: Mar. 21, 1995

[54] METHOD OF SIMULTANEOUSLY PRODUCING TWO CONTINUOUS STREAMS OF CIGARETTES

[75] Inventor: Bruno Belvederi, Via Giovanni, Italy

[73] Assignee: G.D Societa' Per Azioni, Bologna, Italy

[21] Appl. No.: 992,429

[22] Filed: Dec. 17, 1992

[30] Foreign Application Priority Data

Dec. 19, 1991 [IT] Italy ..... BO91A0480

[51] Int. Cl.[6] ..... A24C 5/18

[52] U.S. Cl. ..... 131/84.1; 131/60; 226/195

[58] Field of Search ..... 131/84.1, 58, 60, 65, 131/33, 34; 226/2, 4, 195, 198, 199

[56] References Cited

U.S. PATENT DOCUMENTS

| | | | |
|---|---|---|---|
| 4,336,812 | 6/1982 | Seragnoli | 131/60 X |
| 4,418,705 | 12/1983 | Seragnoli | 131/84.1 |
| 4,583,557 | 4/1986 | Mattei et al. | 131/84.1 |
| 4,685,190 | 8/1987 | Specht et al. | 226/195 X |
| 4,945,926 | 8/1990 | Mattei et al. | 131/84.1 |
| 5,052,296 | 10/1991 | Shiba | 226/195 X |

FOREIGN PATENT DOCUMENTS

| | | |
|---|---|---|
| 3401323 | 8/1984 | Germany . |
| 3542707 | 6/1986 | Germany . |
| 3638751 | 5/1988 | Germany . |
| 2140269 | 11/1984 | United Kingdom . |
| 2167938 | 6/1986 | United Kingdom . |

*Primary Examiner*—Jennifer Bahr
*Attorney, Agent, or Firm*—Marshall, O'Toole, Gerstein, Murray & Borun

[57] ABSTRACT

A method of producing two continuous streams of cigarettes, whereby a continuous paper strip is cut longitudinally into two strips which are fed, through a tobacco loading station and along respective guides for forming respective continuous cigarette rods, to a transverse cutting device by means of respective conveyor belts looped about a number of common pulleys and more specifically about a common drive pulley, and the speed of which is controlled by respective tensioning devices operating at the same pressure.

3 Claims, 2 Drawing Sheets

METHOD OF SIMULTANEOUSLY PRODUCING TWO CONTINUOUS STREAMS OF CIGARETTES

BACKGROUND OF THE INVENTION

The present invention relates to a method of simultaneously producing two continuous streams of cigarettes.

U.S. Pat. No. 4,336,812 relates to a cigarette manufacturing machine for simultaneously producing two continuous cigarette rods from a single paper strip, which is cut longitudinally into two substantially identical strips, which are fed, on respective side by side conveyor belts, along a rod forming beam and through a loading station where a respective stream of shredded tobacco is deposited on to each strip.

A major problem for ensuring correct operation of the above known machine is that of controlling the two conveyor belts so that they travel at substantially the same speed. In fact, by virtue of the paper strips of the two continuous rods on the above machine being cut from the same starting strip, any difference in the traveling speed of the two strips could result in at least one of them tearing.

Devices for controlling the speed of the conveyor belts have been devised, the proposed purpose being to detect, relatively rapidly, any difference in the speed of the conveyors, and accordingly act on the conveyors in such a manner as to eliminate the speed difference as rapidly as possible. In actual use, however, such devices have proved complex, expensive and unreliable.

SUMMARY OF THE INVENTION

It is an object of the present invention to provide a straightforward, low-cost method of controlling the two paper strip conveyors in such a manner as to ensure the strips travel at substantially the same speed.

According to the present invention, there is provided a method of producing two continuous streams of cigarettes, whereby a continuous paper strip is cut longitudinally into two strips, which are fed, through a tobacco loading station and along respective guides for forming respective continuous cigarette rods, to a transverse cutting device by means of respective conveyor belts, each engaging a number of guide pulleys and a drive pulley; characterized by the fact that said pulleys are common to both conveyor belts, the speed of which is controlled by subjecting both conveyor belts to the same tensile stress as said strips are fed forward.

In connection with the above method, it should be pointed out that, unlike similar known methods, it provides, not for rapidly eliminating any difference in the traveling speed of the two conveyor belts, but quite simply for preventing any such difference occurring. The above method, in fact, is based on the fact that, when a common drive pulley is employed for both belts, any difference in the traveling speed of the belts is substantially due to differing wear of the belts, in turn due to differing slippage of the belts in relation to the common drive pulley. As such, any difference in the traveling speed of the belts may be eliminated at the outset by preventing unequal slippage and, consequently, unequal wear of the belts.

According to the above method, the conveyor belts are preferably subjected externally to said tensile stress via respective tensioning means operated at the same pressure.

According to a preferred embodiment of the above method, said tensioning means comprise two actuators operated by pressurized fluid supplied by a common conduit.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
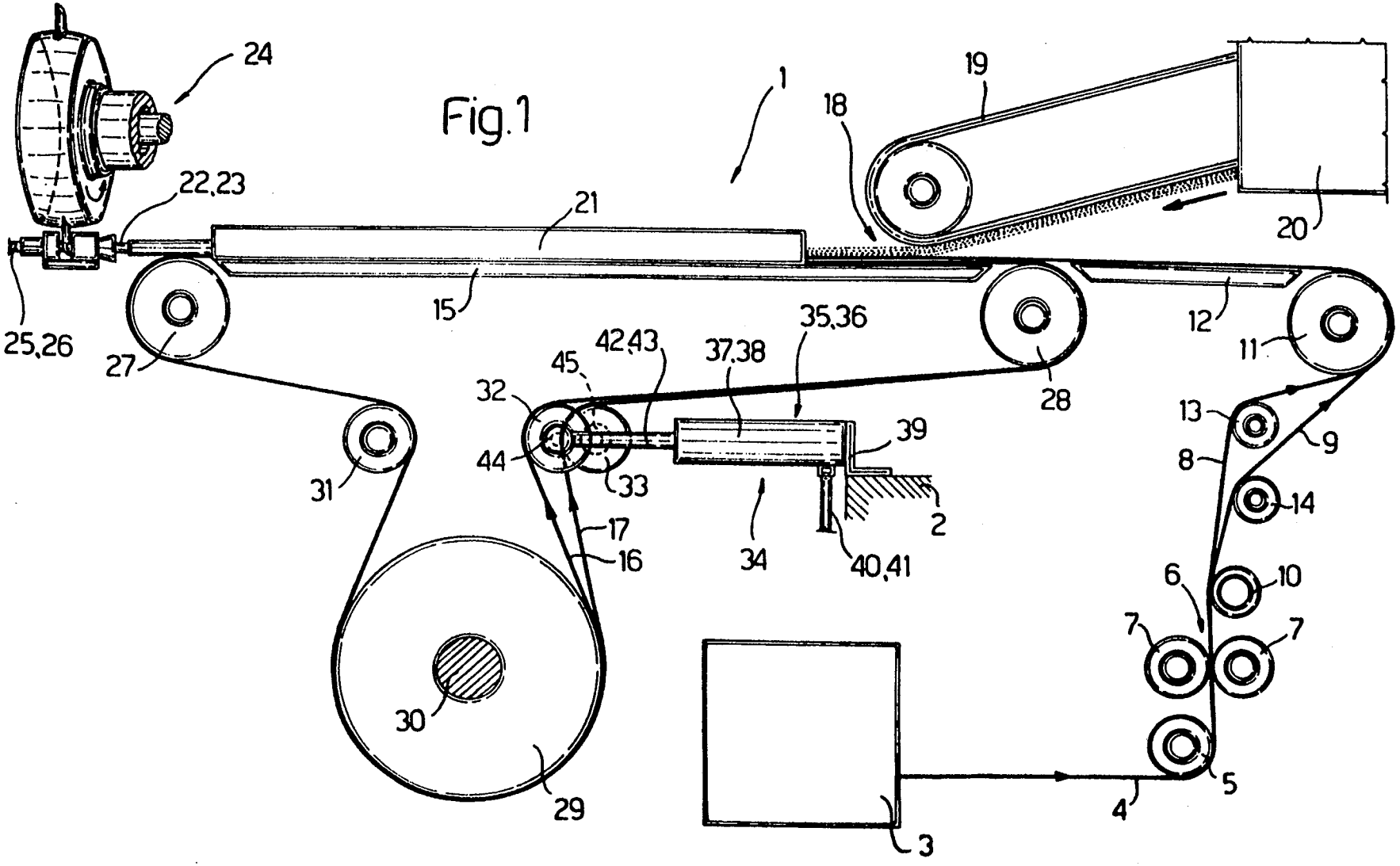
FIG. 1 shows a partial schematic and block diagram of a cigarette manufacturing machine implementing the method according to the present invention.

Number 1 in FIG. 1 indicates a cigarette manufacturing machine comprising a base 2 supporting a device 3 for supplying a continuous strip 4 of cigarette paper of twice the width of strips normally used for producing continuous cigarette rods on single-rod machines.

Downstream from device 3, strip 4 is fed about a guide roller 5 and through a first cutting device 6 comprising two disk cutters 7 arranged tangentially contacting each other and which provide for cutting strip 4 longitudinally into two substantially identical strips 8 and 9.

Downstream from cutting device 6, strips 8 and 9 are fed about a transmission roller 10 and then about a further transmission roller 11 by which they are guided on to a fixed, substantially horizontal bed 12 supported on base 2.

Between rollers 10 and 11, provision is made for two guide rollers 13 and 14 by which, as shown for the sake of clarity in FIG. 1, strips 8 and 9 are fed along two paths offset in relation to each other. In actual fact, however, rollers 13 and 14 are coaxial, and strips 8 and 9 are fed along substantially identical paths.

Downstream from bed 12 in the traveling direction of strips 8 and 9, provision is made for a second horizontal bed 15 substantially coplanar with bed 12 and supporting the top branches of two side by side conveyor belts 16 and 17.

As they travel along bed 15, strips 8 and 9 are fed through a loading station 18 where each strip 8, 9 is loaded with a continuous stream of shredded tobacco by a suction conveyor belt 19 at the output of a known feed unit 20.

Downstream from loading station 18, strips 8 and 9 engage a forming beam 21 supported on bed 15 and which, in known manner, provides for forming strips 8 and 9 and the respective streams of shredded tobacco into two continuous cigarette rods 22 and 23. At the output end of bed 15, rods 22 and 23 are fed through a second known cutting device 24 by which they are cut simultaneously into two continuous streams of cigarette portions 25 and 26.

As shown in FIG. 1, belts 16 and 17 are looped about common transmission rollers 27 and 28 at either end of bed 15, about a common drive roller 29 fitted to a drive shaft 30 rotating anticlockwise in FIG. 1, and about a common transmission roller 31 located between transmission roller 27 and drive roller 29 and designed to ensure belts 16 and 17 contact a given peripheral portion of drive roller 29.

On the opposite side of drive roller 29 in relation to transmission roller 31, belts 16 and 17 are wound about respective rollers 32 and 33 located between drive roller 29 and transmission roller 28 and constituting the output members of a tensioning device 34.

Figure 2:
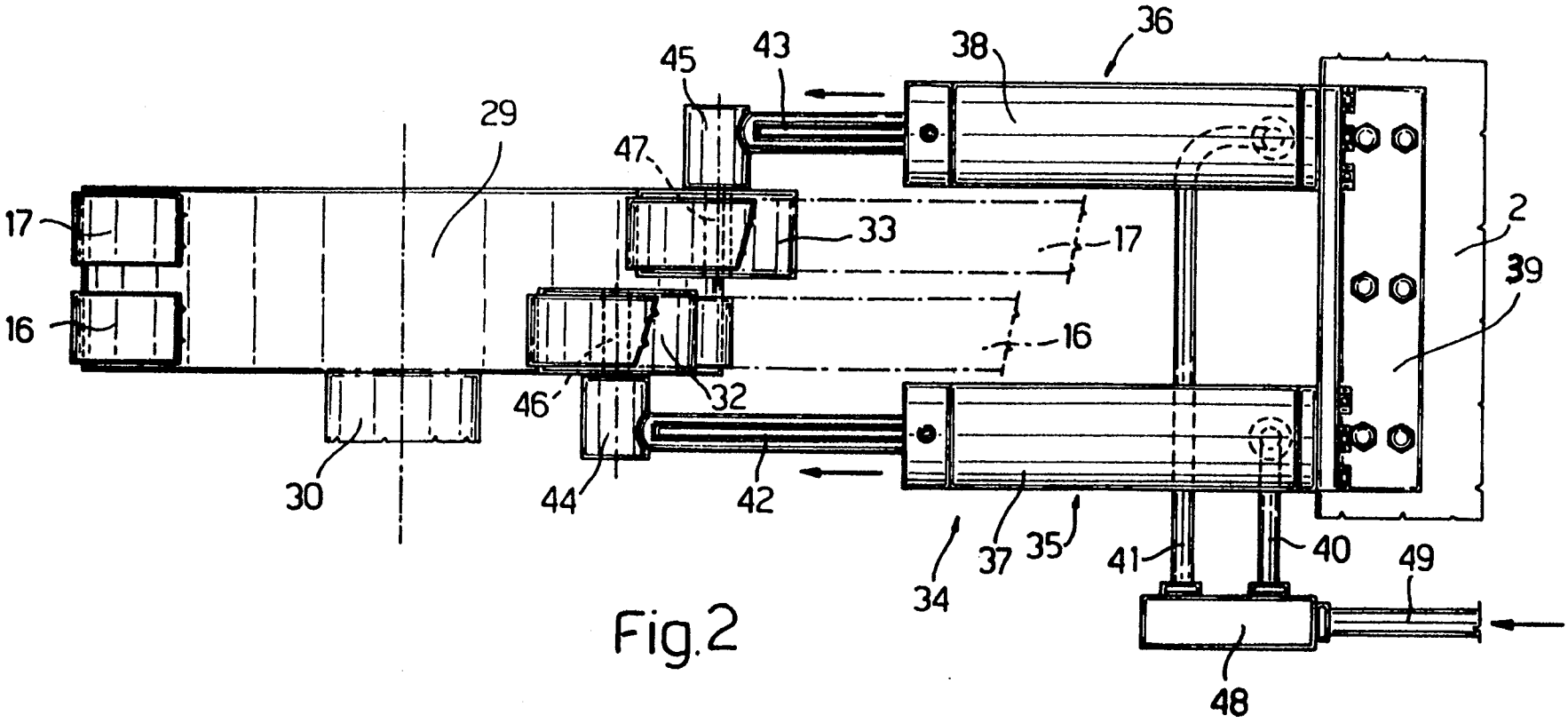
FIG. 2 shows a larger-scale bottom view of a detail in FIG. 1.

As shown more clearly in FIG. 2, tensioning device 34 comprises two hydraulic actuators 35 and 36, which, in the example shown, are single-acting spring-return types, but which may be replaced by corresponding double-acting actuators (not shown). Actuators 35 and 36 comprise respective cylinders 37 and 38 supported on base 2 via a connecting bracket 39 and connected to respective pressurized fluid supply conduits 40 and 41. When fed inside cylinders 37 and 38, the pressurized fluid pushes out two rods 42 and 43, the free ends of which are fitted with respective square sleeves 44 and 45 having respective shafts 46 and 47 supporting in rotary manner rollers 32 and 33.

Both conduits 40 and 41 extend from a single header 48 communicating with a single pressurized fluid supply conduit 49, so that cylinders 37 and 38 tend to remain at the same pressure. Any difference in the pressures applied externally on rods 42 and 43 by belts 16 and 17 via rollers 32 and 33 results in differing axial displacement of rods 42 and 43, which thus provide for re-establishing the same external pressure and, consequently, the same tension on both belts 16 and 17.

I claim:

1. A method of producing two continuous streams of cigarettes, including the steps of cutting a continuous paper strip (4) longitudinally into two strips (8, 9);

feeding the two strips (8, 9) through a tobacco-loading station (18) and along respective guides (21) by means of respective endless conveyor belts (16, 17), each belt being wound about a number of guide pulleys (27, 28, 31) and a drive pulley (29), for forming respective continuous cigarette rods (22, 23);

advancing the cigarette rods (22, 23) to a transverse cutting device (24);

and operating the cutting device (24) to transversely cut the cigarette rods (22, 23) into said two streams of cigarettes;

each of said guide and drive pulleys (27, 28, 29, 31) engaging both conveyor belts (16, 17), the speeds of the conveyor belts (16, 17) being controlled by subjecting both conveyor belts (16, 17) to the same tensile stress as the strips (8, 9) are fed forward.

2. A method as claimed in claim 1, wherein said tensile stress is applied externally to the conveyor belts (16, 17) via respective tensioning means (35, 36) operated at the same pressure.

3. A method as claimed in claim 2, wherein said tensioning means comprises two fluid operated actuators (35, 36), said same pressure being obtained by pressurized fluid supplied at said pressure by a common conduit (49) to said actuators.

* * * * *